US008317112B2

(12) United States Patent
Spiers et al.

(10) Patent No.: US 8,317,112 B2
(45) Date of Patent: Nov. 27, 2012

(54) HIGH PRESSURE FUEL INJECTOR SEAT THAT RESISTS DISTORTION DURING WELDING

(75) Inventors: Dean Leigh Spiers, Yorktown, VA (US); William J. Imoehl, Williamsburg, VA (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 385 days.

(21) Appl. No.: 12/692,691

(22) Filed: Jan. 25, 2010

(65) Prior Publication Data

US 2011/0180635 A1 Jul. 28, 2011

(51) Int. Cl.
*B05B 1/30* (2006.01)

(52) U.S. Cl. ..... 239/585.5; 239/533.11; 239/5

(58) Field of Classification Search ..... 239/585.1, 239/585.3, 585.4, 585.5, 584, 533.2, 533.11, 239/533.12, 88, 5; 251/129.15, 129.21, 127
See application file for complete search history.

(56) References Cited

U.S. PATENT DOCUMENTS 5,165,656 A * 11/1992 Maier et al. ..... 251/129.21
5,580,001 A * 12/1996 Romann et al. ..... 239/585.4
5,915,626 A * 6/1999 Awarzamani et al. ..... 239/135
5,975,436 A * 11/1999 Reiter et al. ..... 239/585.1

FOREIGN PATENT DOCUMENTS

DE 19726991 A1 1/1999
EP 1195515 A2 4/2002
EP 1998039 A2 12/2008
WO 03/067076 A1 8/2003

OTHER PUBLICATIONS

International Search Report dated Sep. 19, 2011 from corresponding International Patent Application No. PCT/US2011/022276.

* cited by examiner

*Primary Examiner* — Davis Hwu

(57) ABSTRACT

A valve seat (16') for a fuel injector (10) includes a main body (27) having a proximal and a distal end with at least one orifice (24) extending through the main body. A seating surface (22) is provided on the main body to receive a closure member (20) of a fuel injector such that when the closure member engages the seating surface, the at least one orifice is closed. A guide surface (36) is provided on the main body to guide movement of the closure member. An annular wall (26) extends in a cantilever manner from the main body at the distal end thereof and defines an outer peripheral portion of the valve seat. The wall is constructed and arranged to deform during welding at the wall so as to isolate effects of the welding from the seating surface and the guide surface.

15 Claims, 3 Drawing Sheets

HIGH PRESSURE FUEL INJECTOR SEAT THAT RESISTS DISTORTION DURING WELDING

FIELD OF THE INVENTION

The invention relates to fuel injectors for vehicles and, more particularly, to a high pressure fuel injector seat that resists distortion during welding when assembled.

BACKGROUND OF THE INVENTION

With reference to FIG. 1, a typical construction of a gasoline fuel injector, generally indicated at 10, includes a valve body 12, in which a valve seat 14 is hermetically secured via a weld 16. The valve seat 14 has multiple functions such as to provide 1) a guide for the armature tube ball assembly, generally indicated at 18, 2) a conical sealing surface on which the ball 20 sits, and 3) orifice holes for spray generation.

The valve seat 14 is a machined and ground part and is fixed to the valve body 12 via the hermitic weld 16 through the valve body wall and into the valve seat 14. During this operation, the material that was molten during the weld process shrinks during cooling causing distortion of the seat 14.

The distortion imposed on the critical areas of the seat 14 can be modeled through a displacement in the weld area. In a simulation, a four micron uniform displacement in the weld area was shown to result in an equivalent or greater displacement in the guide and seal area of the seat 14. It is noted that distortion by welding is not uniform and the resulting distortion of the seat 14 is thus also not uniform. This distortion of the seat 14 results in leaks at the seal and non-uniform shrinkage of the guide portion of the seat 14, which cause durability problems of the fuel injector 10.

Thus, there is a need to provide an improved fuel injector seat that resists distortion during welding upon assembly.

SUMMARY OF THE INVENTION

An object of the present invention is to fulfill the need referred to above. In accordance with the principles of an embodiment, this objective is obtained by providing a valve seat for a fuel injector that includes a main body having a proximal and a distal end with at least one orifice extending through the main body. A seating surface is provided on the main body to receive a closure member of a fuel injector such that when the closure member engages the seating surface, the at least one orifice is closed. A guide surface is provided on the main body to guide movement of the closure member. An annular wall extends in a cantilever manner from the main body at the distal end thereof and defines an outer peripheral portion of the valve seat. The wall is constructed and arranged to deform during welding at the wall so as to isolate effects of the welding from the seating surface and the guide surface.

In accordance with another aspect of the invention a method is provided to isolate a seating surface and a guide surface of a valve seat of a fuel injector during a welding process. A valve seat includes a main body having a proximal and a distal end, at least one orifice extending through the main body, a seating surface on the main body constructed and arranged to receive a closure member of a fuel injector such that when the closure member engages the seating surface, the at least one orifice is closed, a guide surface on the main body constructed and arranged to guide movement of the closure member, and an annular wall extending in a cantilever manner from the main body at the distal end thereof and defining an outer peripheral portion of the valve seat. The method includes welding the valve seat to a valve body of a fuel injector so that the annular wall deforms during welding thereby to isolating effects of the welding from the seating surface and the guide surface.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENTS

Figure 1:
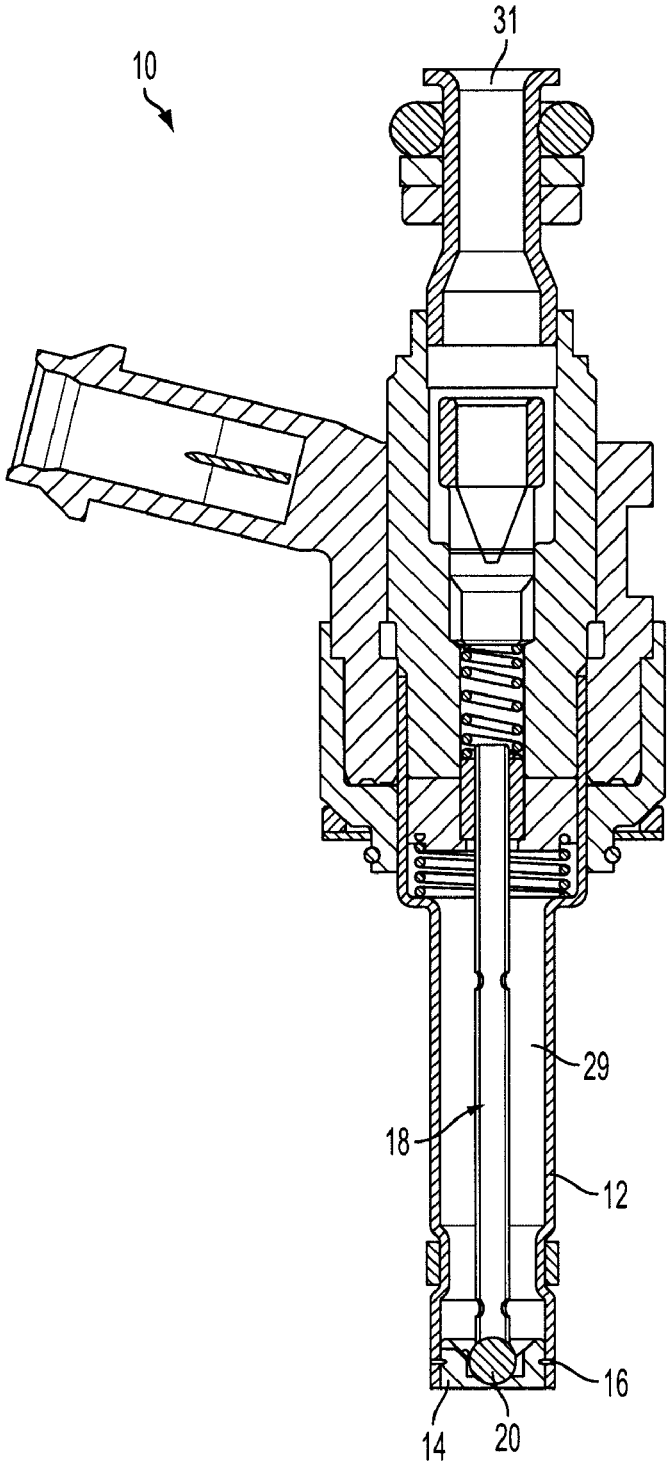
FIG. 1 PRIOR ART
FIG. 1 is a sectional view of a conventional fuel injector having a valve seat welded to a valve body.
Figure 2:
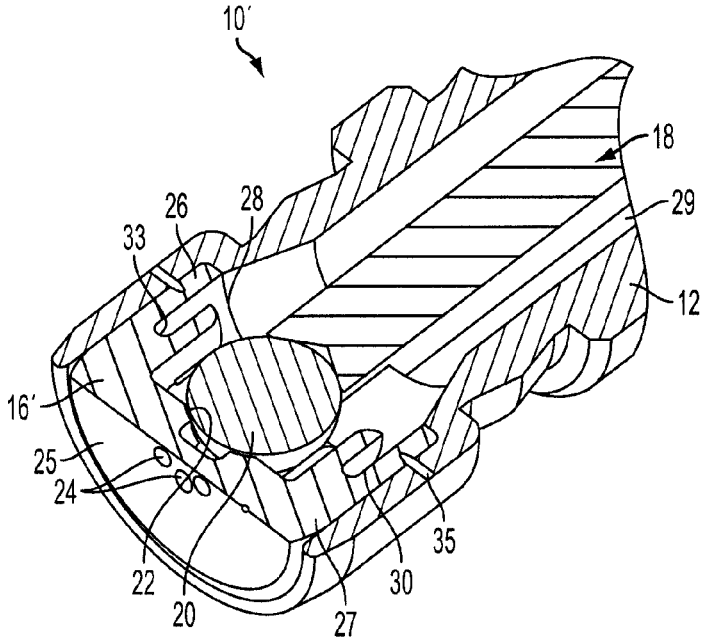
FIG. 2 is a sectional view of a valve seat provided in accordance with a first embodiment shown welded to a valve body of a fuel injector.

Referring to FIG. 2, a valve seat 16' of a gasoline-type, solenoid operated fuel injector 10' is shown in accordance with a first embodiment. The fuel injector 10' is of the type shown in FIG. 1, except that the valve seat 16' is constructed and arranged to resist distortion thereof during welding to the valve body 12 of the injector 10'.

The valve seat 16' defines a seating surface 22, which can have a frustoconical or concave shape, facing the interior of the valve body 12. The seating surface 22 includes at least one fuel outlet opening 24 through a proximal end 25 of a main body 27 of the seat 16'. The opening 24 is in communication with an inlet tube 29 for conducting pressurized fuel into the valve body 12 against the seating surface 22. The inlet tube 29 defines an inlet end 31 (see FIG. 1) of the injector 10' and is typically mounted to a fuel rail (not shown) as is known.

A closure member, e.g., a spherical valve ball 20, within the injector 10' is moveable between a first, seated or closed, position and a second, open position. In the closed position, the ball 20 is urged against the seating surface 22 to close the outlet opening(s) 24 against fuel flow. In the open position, the ball 20 is spaced from the seating surface 22 to allow fuel flow through the outlet opening(s) 24. The closure member 20 is part of the armature tube ball assembly 18 that is connected to an armature (not shown) in the conventional manner. A spring (not shown) biases the armature and thus the valve ball 20 toward the closed position. The valve body 12, armature, and valve ball 20 define a valve group assembly such as disclosed in U.S. Pat. No. 6,685,112 B1, the contents of which is hereby incorporated herein by reference.

The fuel injector 10' includes an electromagnetic coil (not shown) that is operable, in the conventional manner, to produce magnetic flux to draw the armature and thus the armature tube ball assembly 18 away from the seating surface 22, thereby moving the valve ball 20 to the open position and allowing fuel to pass through the fuel outlet opening(s) 24. Deactivation of the electromagnetic coil allows the above-mentioned spring to return the valve ball 20 to the closed position against the seating surface 22 and to align itself in the closed position, thereby closing the outlet opening(s) 24 against the passage of fuel. The electromagnetic coil is DC operated. The coil is part of a power or coil subassembly such as disclosed in U.S. Pat. No. 6,685,112 B1.

With reference to FIG. 2, to resist distortion during welding of the seat 16' to the valve body 12, the seat 16' includes an annular skirt or wall 26 at a distal end 28 of the main body 27. The wall 26 is constructed and arranged to be deformed during welding. In the embodiment of FIG. 2, the wall 26 is defined by an annular groove 30 in the main body 27 of the seat 16'. The groove 30 is open at the distal end 28 of the seat 16'. Thus, the wall 26 of the seat 16' is joined to the main body 25 only at a bottom 33 thereof in a cantilever manner. The wall 26 thus defines an outer peripheral portion of the valve seat 16' to which the valve body 12 is welded.

Figure 3:
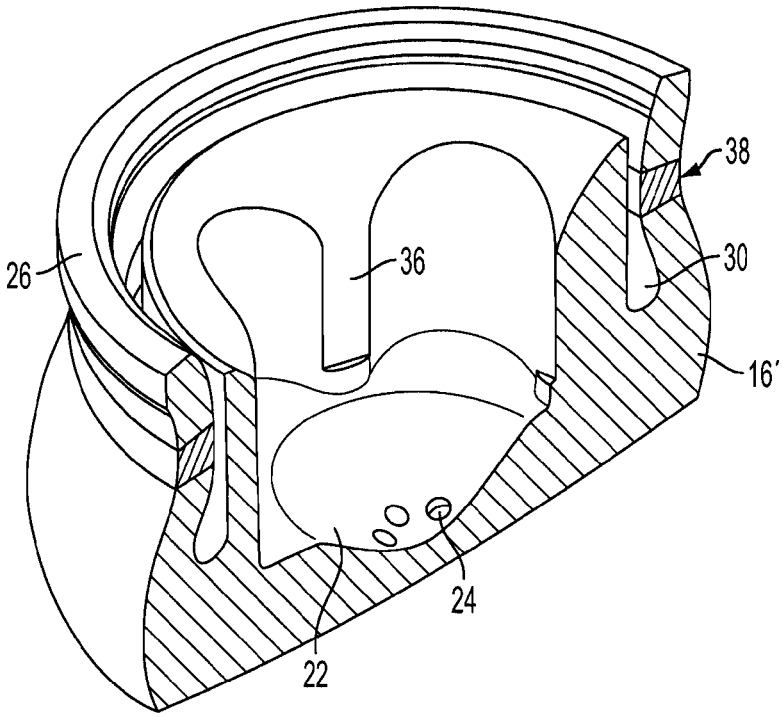
FIG. 3 is an enlarged perspective view of half of the valve seat of FIG. 2 showing a weld area, a seal surface and a guide surface thereof.

With reference to FIG. 3, the outer wall 26 acts as a "hinge" (the wall 26 near distal end 28 can deform and move with respect to the fixed bottom 33 thereof), isolating the seating surface 22 and a guide surface 36, from the influence of the weld 35 (FIG. 2) at the weld area, generally indicated at 38. The guide surface 36 guides the valve ball 20 and thus the armature tube ball assembly 18. Simulation models have shown that this embodiment results in improvement in displacement of the critical areas (seating surface and guide surface) as compared to those areas in the seat 16 of FIG. 1. In the critical areas shown in FIG. 3, there is greater than an order of magnitude less distortion that in the conventional seat 16.

Figure 4:
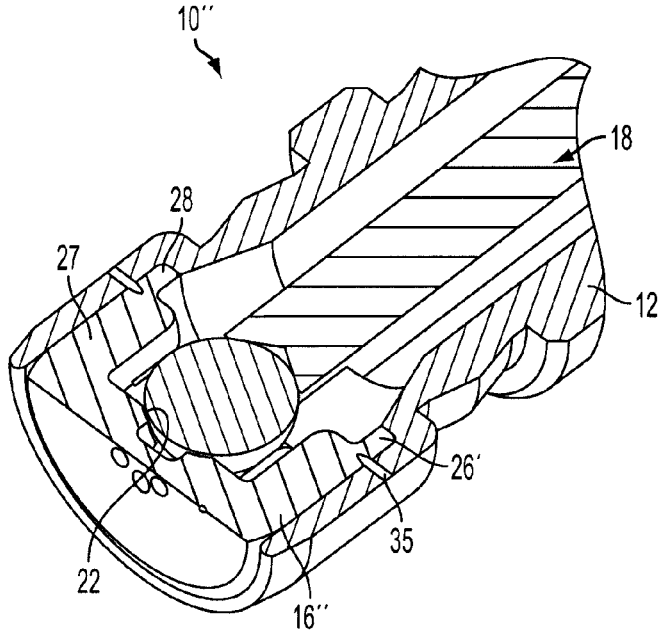
FIG. 4 is a sectional view of a valve seat provided in accordance with a second embodiment shown welded to a valve body of a fuel injector.

FIG. 4 shows a second embodiment of the valve seat 16" provided in a fuel injector 10". In this embodiment, no groove is provided and the wall 26' extends from the main body 27 of the seat 16" in a cantilever manner at the distal end 28 thereof. The wall 26' has a thickness less than the thickness of each of the seating surface 22 and guide surface 36 (same as in FIG. 3) so that the wall 26' will deform instead of these surfaces 22 and 34 during welding. As shown in FIG. 4, the weld 35 secures the valve body 12 to the annular wall 26'.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A valve seat for a fuel injector comprising:

a main body having a proximal and a distal end, at least one orifice extending through the main body, a seating surface on the main body constructed and arranged to receive a closure member of a fuel injector such that when the closure member engages the seating surface, the at least one orifice is closed, a guide surface on the main body constructed and arranged to guide movement of the closure member, and a first annular wall extending in a cantilever manner from the main body at the distal end thereof and defining an outer peripheral portion of the valve seat, the first annular wall being constructed and arranged to deform during welding at the wall so as to isolate effects of the welding from the seating surface and the guide surface, wherein the first annular wall includes an annular groove in the distal end of the main body, the groove being open at the distal end of the main body and defining a secondary annular wall spaced from the first annular wall with the groove there-between.

2. The valve seat of claim 1, wherein the first annular wall has a thickness less than a thickness of each of the guide surface and the seating surface.

3. The valve seat of claim 1, wherein the seating surface is generally concave.

4. The valve seat of claim 1, in combination with the fuel injector, the fuel injector including a valve body welded to the valve seat at the first annular wall.

5. The combination of claim 4, wherein the fuel injector is a solenoid operated gasoline fuel injector.

6. The combination of claim 4, wherein the closure member is a spherical ball valve and the seating surface is concave.

7. A valve seat for a fuel injector comprising:

a main body having a proximal and distal end, at least one orifice extending through the main body, means, on the main body, for seating, the means for seating being constructed and arranged to receive a closure member of a fuel injector such that when the closure member engages the means for seating, the at least one orifice is closed, means, on the main body, for guiding movement of the closure member, and means for deforming extending in a cantilever manner from the main body at the distal end thereof and defining an outer peripheral portion of the valve seat, the means for deforming being constructed and arranged to deform during welding so as to isolate effects of the welding from the means for seating and the means for guiding, wherein the means for deforming is a first annular wall including an annular groove in the distal end of the main body, the groove being open at the distal end of the main body and defining a secondary annular wall spaced from the first annular wall with the groove there-between.

8. The valve seat of claim 7, wherein the first annular wall and the means for seating is a seating surface and the means for guiding is a guide surface, the first annular wall having a thickness less than a thickness of each of the guide surface and the seating surface.

9. The valve seat of claim 7, wherein the means for seating is a generally concave surface.

10. The valve seat of claim 7, in combination with a fuel injector, the fuel injector including a valve body welded to the valve seat at a location of the means for deforming.

11. The combination of claim 10, wherein the fuel injector is a solenoid operated gasoline fuel injector.

12. The combination of claim 10, wherein the closure member is a spherical ball valve and the seating surface is concave.

13. A method of isolating a seating surface and a guide surface of a valve seat of a fuel injector during a welding process, the method comprising:

providing a valve seat comprising:

a main body having a proximal and a distal end, at least one orifice extending through the main body, a seating surface on the main body constructed and arranged to receive a closure member of a fuel injector such that when the closure member engages the seating surface, the at least one orifice is closed, a guide surface on the main body constructed and arranged to guide movement of the closure member, and a first annular wall extending in a cantilever manner from the main body at the distal end thereof and defining an outer peripheral portion of the valve seat, the first annular wall including an annular groove in the distal end of the main body, the groove being open at the distal end of the main body and defining a secondary annular wall spaced from the first annular wall with the groove there-between, and welding the valve seat to a valve body of a fuel injector so that the first annular wall deforms during welding thereby to isolating effects of the welding from the seating surface and the guide surface.

14. The method of claim 13, wherein the step of providing the valve seat includes defining the first annular wall to have a thickness less than a thickness of each of the guide surface and the seating surface.

15. The method of claim 13, wherein the welding step includes welding the valve body to the first annular wall.

* * * * *